United States Patent [19]
Silvilotti et al.
[11] 4,420,381
[45] Dec. 13, 1983

[54] ELECTROLYTIC METHOD AND CELL FOR METAL PRODUCTION

[75] Inventors: Olivo G. Silvilotti, Kingston, Canada; Junkichi Iseki, Osaka, Japan

[73] Assignee: Alcan International Limited, Montreal, Calif.

[21] Appl. No.: 347,084

[22] Filed: Feb. 8, 1982

[30] Foreign Application Priority Data

Feb. 26, 1981 [GB] United Kingdom ..... 8106040

[51] Int. Cl.[3] ..... C25C 3/00; C25C 3/04; C25C 7/06

[52] U.S. Cl. ..... 204/70; 204/64 R; 204/243 R; 204/245; 204/246; 204/247; 204/274

[58] Field of Search ..... 204/64 R, 64 T, 65, 204/66-70, 243 R, 245, 246, 247, 274

[56] References Cited

U.S. PATENT DOCUMENTS

| | | | |
|---|---|---|---|
| 864,928 | 9/1907 | Seward et al. | 204/70 |
| 1,007,897 | 11/1911 | Seward et al. | 204/245 |
| 4,222,841 | 9/1980 | Miller | 204/274 |
| 4,298,437 | 11/1981 | Hind | 204/70 |

*Primary Examiner*—Howard S. Williams
*Attorney, Agent, or Firm*—Cooper, Dunham, Clark, Griffin & Moran

[57] ABSTRACT

In the production of magnesium by electrolysis of a fused salt the metal is collected over a body of the fused salt under a heavily insulated cover to reduce heat loss from the molten metal under a substantially non-oxidizing atmosphere. The electrolyte is held down to a controlled temperature somewhat above the melting point of magnesium by means of a heat exchanger which projects into the fused electrolyte and is arranged so as to avoid significant uptake of heat from the supernatant molten metal. This arrangement permits the electrolyte temperature to be controlled with reduced formation of sludge and extended cell life by avoidance of exposure of the electrolyte to atmospheric moisture.

10 Claims, 3 Drawing Figures

ELECTROLYTIC METHOD AND CELL FOR METAL PRODUCTION

Figure 1:
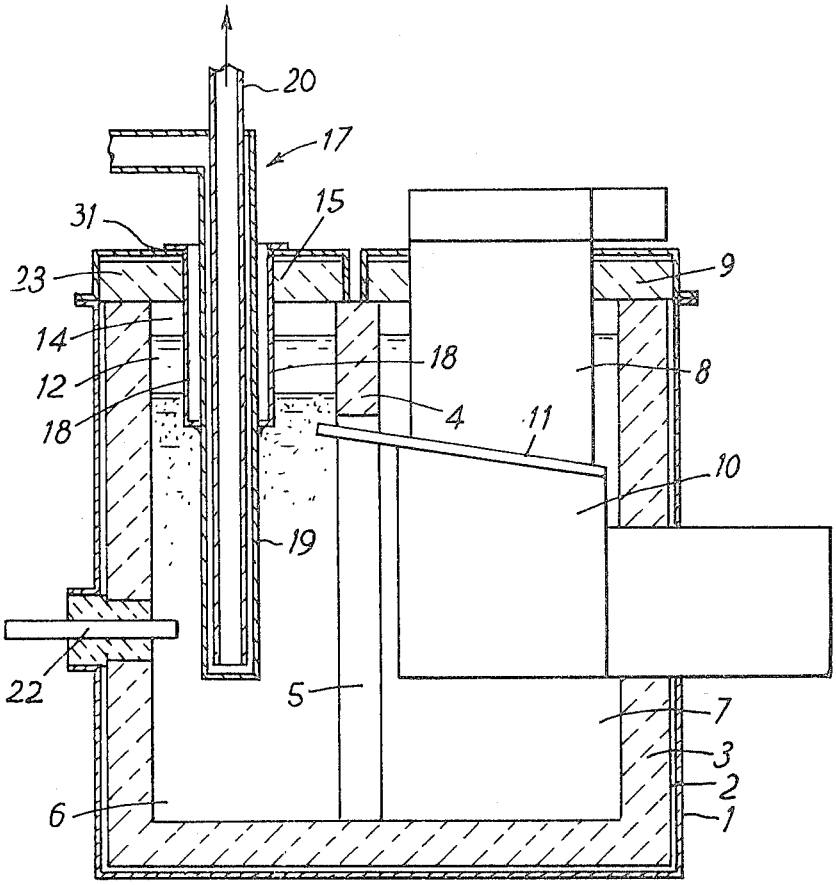

The present invention relates to electrolytic cells for the production of metals by electrolysis of a molten electrolyte and in particular to the construction of a cell of the type in which the electrolyte is more dense than the metal product. The invention is described with reference to the production of magnesium from a molten electrolyte having a substantial content of magnesium chloride, but is applicable to cells for the performance of other electrolytic processes in which similar problems occur.

In the production of magnesium from a relatively dense electrolyte the cathodes and anodes of the cell are arranged with essentially parallel opposed faces which are arranged to extend vertically or at a small angle to the vertical. A plume of chlorine bubbles follows and diverges slightly outwardly from the surface of the anodes and a film of magnesium covers and moves upwardly on the faces of the cathodes. Such upwardly moving film of magnesium is collected at the top margin of the cathodes and is diverted from the cell without coming into contact with the evolved chlorine, with which it would back-react.

The molten magnesium is collected in a tapping well over a body of the molten electrolyte and is maintained at a temperature slightly above its melting point so that it may be tapped out of the collection well by a syphon discharge means in an essentially conventional manner. It is obvious that the cell electrolyte must be held at a temperature above the melting point of the product metal.

It has already been established that the current efficiency of the cell is substantially improved if the temperature of the electrolyte can be held as low as possible, consistent with the requirement that it be above the melting point of the product metal. It was found that the temperature of the electrolyte can be held within to about 20° C. above the melting point of magnesium without introducing operational difficulties when the ascending stream of product metal is collected in an open-bottomed steel collecting vessel which is essentially contained wholly within molten electrolyte in the tapping well, as described in U.S. Pat. No. 3,396,094.

While the temperature of the electrolyte is to be controlled to the smallest possible excess over the melting point of the product metal it is essential to maintain some excess electrolyte temperature at all times to avoid operational difficulties arising from the freezing of the product metal on the cathodes. It was therefore arranged that the heat released in the cell through resistance heating of the electrolyte should somewhat exceed the normal cell heat loss and the temperature control of the electrolyte should be effected by a variable, controlled cooling of the electrolyte.

As well as serving the function of metal collection, the tapping well was also employed for the introduction of molten electrolyte feed and was therefore provided with a hinged, thermally insulated cover which allowed the introduction of molten chloride feed and supplementary electrolyte components and removal of molten metal to take place. Control of the electrolyte temperature was exercised by opening and closing this cover to achieve controlled air cooling of the electrolyte.

As compared with earlier systems, such as the cell described in U.S. Pat. No. 2,785,121, the operation of the cell of U.S. Pat. No. 3,396,094 resulted in a marked improvement in current efficiency and a substantial reduction in the formation of solid sludge in the bottom of the cell since the tapping system resulted in a substantial reduction in the burning of the molten magnesium, which was a normal incident in magnesium cells of earlier types.

It was found in operation that the service life of the cell was about one year. After that time the operating efficiency of the cell declined and the cell required to be shut down for overhaul. In particular the sludge required removal from the bottom of the cell. It was particularly the accumulation of sludge in the bottom of the cell which resulted in decrease of efficiency of operation. The formation of sludge was due in part to the formation of magnesium oxide as the result of oxidation of some exposed magnesium metal and to the introduction of MgO and magnesium oxychloride in the molten $MgCl_2$ feed, as the result of hydrolysis of the $MgCl_2$ before and during introduction into the cell.

The presence of fine solid particles in the electrolyte leads to contamination of the surfaces of the cathodes by oxide deposits, which prevent maintenance of a continuous metal film on the cathode surface and reduction of current efficiency until such deposits are removed.

It was not appreciated that a substantial proportion of the sludge accumulation was due to hydrolysis of the electrolyte as a result of the exposure to atmosphere in the tapping well during the electrolyte temperature controlling operation, in which the cover of the tapping well was raised.

It has now been realised according to the present invention that a substantial reduction of sludge formation and a substantial increase in cell service life can be achieved, while retaining the advantage of controlling the electrolyte temperature to a value close to the molten metal temperature for achievement of high current efficiency, by (a) collecting the molten metal as a supernatant layer on the electrolyte to shield the electrolyte from atmospheric moisture, (b) enclosing the space over said molten metal with a thermally insulating cover to minimise heat loss from said molten metal, (c) maintaining an atmosphere in the space over the molten metal for reducing oxidation of such metal to a non significant level, (d) holding down the electrolyte temperature to a desired value by passage of a heat exchange fluid through heat exchanger means in direct contact with the molten electrolyte.

The heat exchanger is most conveniently arranged so that it extends downwardly through the top of the product collection chamber through the molten metal layer and into the molten electrolyte. The desired atmosphere over the molten metal may be achieved by substantially hermetically sealing off said space from atmosphere and/or bleeding into said space an inert gas such as argon or an oxidation inhibiting gas such as $SO_2$ or $SF_6$ or other oxidation inhibitor, such as are conventionally employed in magnesium casting operations. It has been found that the addition of argon in such amounts as to retain the oxygen level of the atmosphere in the space at around or below 1%, the atmospere is effective to prevent rapid oxidation of molten magnesium at the operating temperature. The heat exchanger may be arranged both for removal of heat from the electrolyte by passage of relatively cool fluid and for introduction of heat into the electrolyte by employing a highly heated fluid as the heat exchange medium circulated through the heat exchanger. As an alternative to employing the heat exchanger as a means of introducing supplementary heat into the cell, other forms of heating may be employed for raising the temperature of the electrolyte in the tapping well. Thus supplementary heat may be supplied to the electrolyte by passage of alternating current between spaced electrodes in contact with the electrolyte.

As a further alternative means may be employed to introduce supplementary heat directly into the supernatant metal layer, especially to increase fluidity before tapping, such means being radiant or preferably immersion heaters, supplied by electrical power or gas flames.

The heat exchanger system, mentioned above, when used as a cooler, is preferably arranged so that there is at most a virtually insignificant take-up of heat from the supernatant molten metal layer.

A preferred form of heat exchanger comprises an outer tubular collar, supported in the tapping well cover and extending downwardly through the molten metal into the electrolyte. A metal heat exchanger tube of external diameter less than the internal diameter of the collar extends downwardly through the collar and is sealed into the lower end of the collar to effectively insulate the heat exchanger tube from the body of molten metal. The space between the collar and the heat exchanger tube is preferably filled with heat insulation material. The heat exchanger tube extends downwardly below the collar to a location towards the bottom of the electrolyte in the tapping well. The lower end of the heat exchanger tube is closed off. A further tube of smaller diameter is provided concentric with the heat exchanger tube and acts as an outlet for the heat exchange fluid and is preferably formed of a refractory material to prevent reverse heat flow from the heated outgoing fluid. The advantage of this form of heat exchanger is that it may be withdrawn for replacement without disturbing the tapping well cover.

Alternatively, a simple U-shaped heat exchanger may be mounted in collars in the tapping well cover. Such an arrangement is simpler, but replacement is somewhat more difficult in that removal of the tapping well cover would be required.

Figure 2:
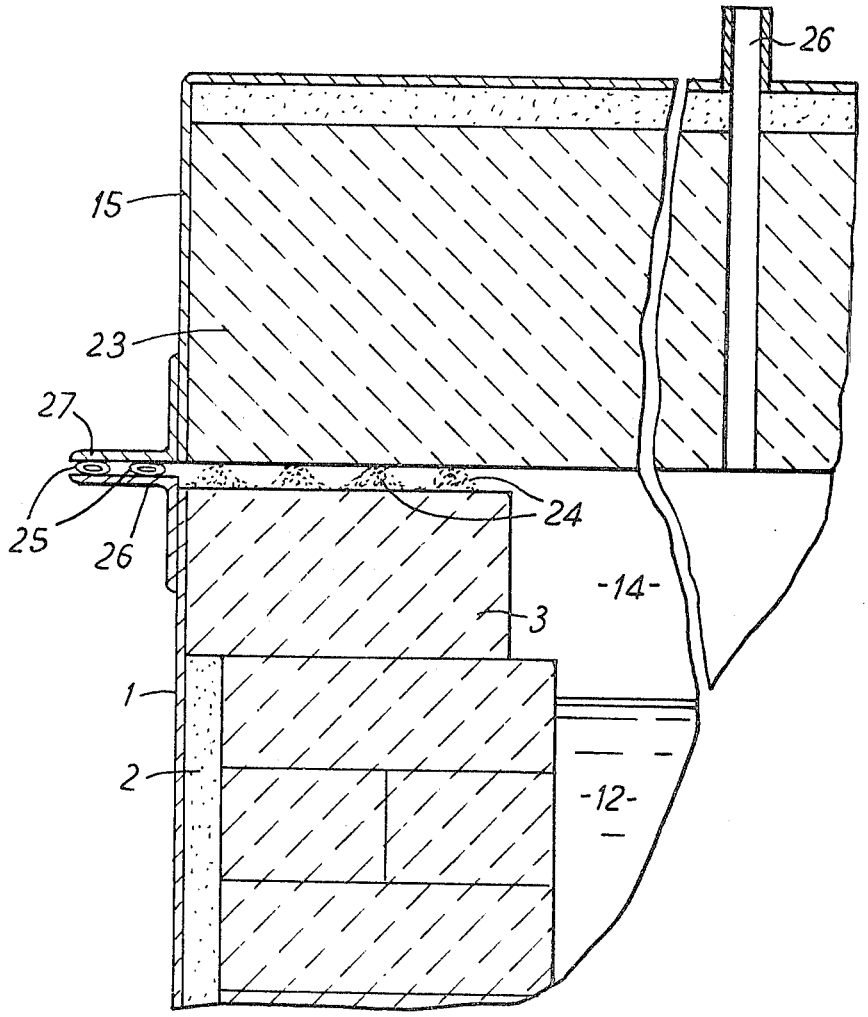
Figure 3:
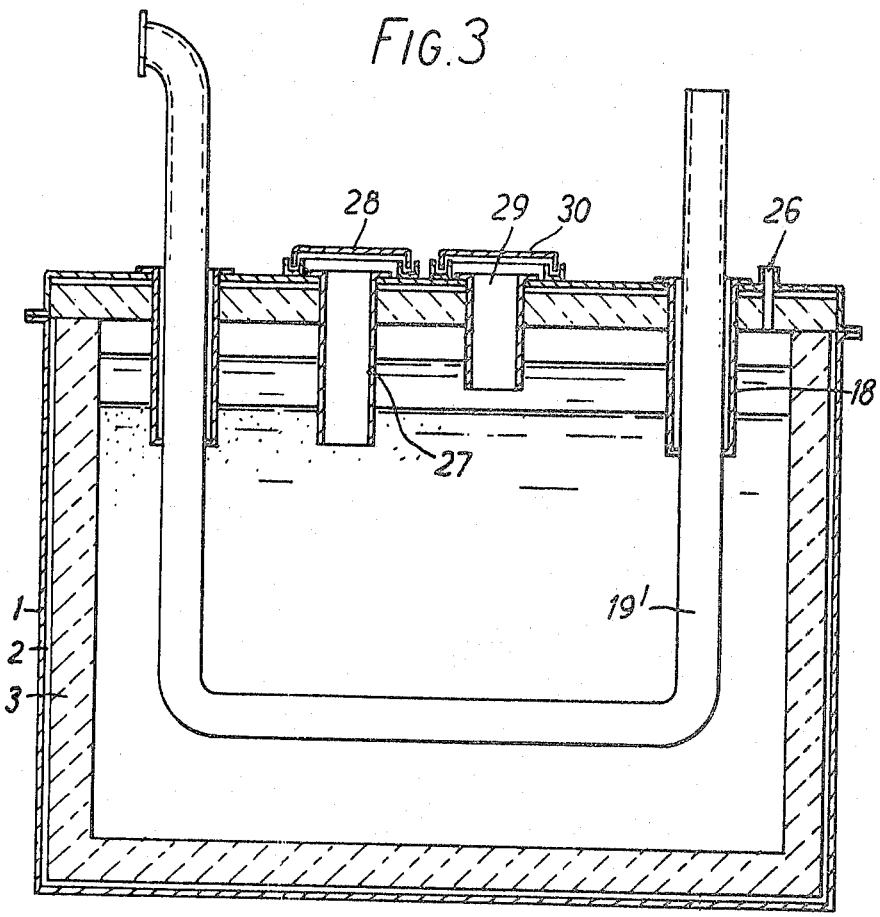

One form of electrolytic cell in accordance with the invention is illustrated in the accompanying drawings in which FIG. 1 is a vertical section of the cell and FIG. 2 is an enlarged section of part of the cover of the tapping well and FIG. 3 is a vertical section of the cell of FIG. 1 in a plane perpendicular to FIG. 1 but showing a U-shaped heat exchanger.

The cell, as shown in FIG. 1, comprises a steel outer shell 1, a layer 2 of thermal insulation and a massive refractory lining 3 of material which is resistant to both molten magnesium and the molten chloride electrolyte (which may contain a small proportion of fluoride).

The cell includes a refractory curtain wall 4, in which elongated ports 5 are formed. The curtain wall 4 separates a tapping well 6 from an electrolysis chamber 7, in which are located a series of parallel anodes 8, carried in an insulated cover 9, interleaved with a series of parallel cathodes 10. The cell is filled with molten electrolyte containing $MgCl_2$ and halides of other more electropositive metals, such as NaCl, KCl and $CaCl_2$ and having a higher density than molten magnesium. In operation chlorine is given off at the anodes 8 and collects under slightly negative pressure in the headspace of the electrolysis chamber 7, from which it is discharged through an outlet duct (not shown). A film of molten magnesium is formed on the surface of each cathode 10 and is discharged from the electrolysis chamber 7 to the tapping well 6. For that purpose each cathode 10 is provided with an inverted, upwardly sloping gutter 11 for carrying the product metal from the electrolysis chamber 7 into the tapping well through a port 5 in wall 4, essentialy as described in U.S. Pat. No. 3,396,094.

The product metal forms a supernatant layer 12 on the molten electrolyte in the tapping well 6, the bottom limit of the layer 12 being above the top of the elongated ports 5.

The product metal layer 12 is confined under a headspace 14 by a heavily insulated fixed cover 15 which is sealed to the cell wall above the tapping well 6, as described more fully below.

One or more heat exchanger units 17 are mounted in the cover 15. Each such unit consists of a steel collar 18, which extends downwardly below the lower operational limit of the metal product layer 12, a steel heat exchanger tube 19 carried by the collar 18 and spaced from it by a layer of insulation material (not shown) and a concentric refractory flue tube 20. In operation cold air is blown in the upper end of tube 19 and is exhausted through the flue tube 20. It is only the portion of tube 19 below the bottom margin of collar 18 which exerts any substantial heat exchange function.

An alternative form of heat exchanger is shown in FIG. 3. It comprises a U-shaped heat exchanger tube 19', mounted at each end in collars 18 held in the cover 15.

Spaced steel electrodes 22 protrude through the wall of the cell into the electrolyte space for the application of an A.C. heating current to the electrolyte.

The cover 15 is arranged to form a substantially hermetic seal with the refractory lining 3 of the cell, as indicated in FIG. 2. For this purpose a packed layer 24 of salt (NaCl) which remains solid at the process operating temperature is located between the refractory lining 3 of the cell wall and the refractory lining 23 of the cover 15 and compressible rubbery sealing members 25 are located between angle sections 26, 27, respectively forming parts of the cell shell 1 and the cover 15. The members 25 may be formed from temperature-resistant silicone gasket material obtainable from, for example, Parker Packing, Carson City, Nevada, U.S.A. and capable of long term operation at temperatures up to 235° C. The members 25 act as a barrier to the ingress of atmospheric air, while the salt layer 24 acts as a thermal barrier to protect the members 25.

The sealing arrangement illustrated in FIG. 2 extends around three sides of the cover 15. At the fourth side, facing the cover 9, the salt seal between the cell refractory 3 and the cover refractory 23 is continued, but a compressible silicone gasket is interposed between the vertical faces of the covers 9 and 15.

In operation a slow stream of dry argon (or other inert gas, such as nitrogen) is introduced into the headspace 14 via gas inlet 26 in the cover. Even without the above described rubbery seal the oxygen content of the gas in the headspace can be held down to about 1% with an argon stream of 2 liters/min with a tapping well 0.6 meters×4.5 meters.

The headspace 14 in the tapping well preferably varies between 10 cms and 20 cms in the vertical direction.

With the above mentioned heavily insulated fixed cover 15 it is found that the metal layer 12 will remain essentially molten even when the temperature of the electrolyte in the tapping well has fallen to no more than 5° C. above the melting point of magnesium (651° C.), because the total heat losses by conduction to the heat exchanger and the cell walls and by radiation from the surface of the molten magnesium to the cover have been substantially reduced.

In practice it is however preferred to maintain the electrolyte temperature in the range of 660°–670° C. as a protection against sudden and unforeseen shutdowns and power failures, which would result in a reduction of the cell electrolyte temperatureat the rate of about 15° C./hour.

In operation the electrolyte temperature is held down to 660°–670° C. by operation of the heat exchanger 17 with consequent good current efficiency. However it may be desirable to raise the electrolyte temperature to about 680° C. over a period of time just before tapping to increase the fluidity of the metal and remelt any frozen metal that may have formed. After tapping the electrolyte temperature can be restored to the desired 660°–670° C. operating temperature by operation of the heat exchanger.

The heating of the electrolyte may be carried out by A.C. resistance heating employing electrodes 22. Alternatively a stream of higly heated gas may be blown through the heat exchanger for this purpose.

Since the introduction of air through the $MgCl_2$ feed entrance should be held to a minimum, the molten $MgCl_2$ feed is supplied through a conduit 27 which is sealably mounted to the cover 15 and extends down through the molten metal layer 12 into the body of molten electrolyte. The mouth of conduit 27 is enclosed by a light removable cover 28, so that the conduit is effective to hold down the introduction of atmospheric air to a minimum to the residual exposed surface of the electrolyte.

Similarly the tapping of metal is carried out via a small conduit 29 in the cover 15 and is also provided with a light and removable cover 30. Around the edge of the opening 29 a salt seal, not shown, is provided to cooperate with cover 30. This could be supplemented by a rubbery seal, such as 25, in order to reduce the quantity of argon introduced into the cell.

It is a very substantial advantage of the present apparatus that the cooling operation of the heat exchanger 17 can be performed automatically under the control of a thermostat immersed in the electrolyte and of a timer/controller which cuts out the operation of the heat exchanger and cuts in the operation of the A.C. heating circuit. At an appropriate interval before a scheduled tapping operation the temperature setting of the thermostat is raised to 680° C. to prepare the cell for tapping.

It is found that in operation the rate of sludge deposition in the cell of the present invention may be held down to 20 kgs/ton of product metal or lower, as compared with 60 kgs/ton of product metal in the operation of the cell described in U.S. Pat. No. 3,396,094.

It is further found that the rate of erosion of the carbon anodes is reduced to about one third of the previous rate.

As a consequence of these two factors the service life of the cells between major overhauls may be extended from one year to 2–3 years or even more.

It is also a major advantage of the specific design of cell described herein that the requirement to replace the previously employed steel collector vessel has been eliminated. Periodic replacement of the heat exchanger unit shown in FIG. 1 can be be achieved very simply with only very minor exposure of the electrolyte to atmosphere. For this reason the heat exchanger is mounted to the cover 15 by a bolted flange connection provided with an air-tight, heat resistant gasket 31.

We claim:

1. A method for the production of metal by electrolysis of a molten electrolyte, which is more dense than the metal, by passage of current between at least one vertically arranged anode and one vertically arranged cathode immersed in said electrolyte in an electrolysis chamber and conveying the product metal to a product collection chamber characterised in that (a) the molten metal is collected in the product collection chamber as a supernatant layer to shield the electrolyte from atmospheric moisture, (b) a thermally insulating cover is maintained over said molten metal to minimise heat loss from said molten metal, (c) an atmosphere effective for reducing oxidation of such metal to non-significant levels, is maintained over said molten metal, (d) the electrolyte temperature is held down to a desired value by passage of a heat exchange fluid through heat exchanger means in direct contact with the molten electrolyte.

2. A method according to claim 1 further characterised in that heat is removed from the molten electrolyte without significant take up of heat from the supernatant molten metal layer.

3. A method according to claim 1 further characterised in that a stream of an inert gas is introduced into the space above the molten metal layer so as to maintain a non-oxidising atmosphere therein.

4. A method according to claim 1, 2 or 3 for the production of magnesium metal by electrolysis of magnesium chloride further characterised in that in operation the electrolyte is held at a temperature in the range of 660°–670° C.

5. An apparatus for the production of metal by electrolysis of a molten salt which is more dense than said metal, comprising an electrolysis chamber communicating with a product collection chamber, an array of vertically arranged interleaved anode and cathode electrodes being positioned in said electrolysis chamber, each cathode electrode being provided with means for conveying metal released at said cathodes into the product collection chamber, said product collection chamber being provided with a head space isolated from a head space in the electrolysis chamber by a curtain wall which extends downwardly to a level below the normal operating upper level of the electrolyte in said product collection chamber characterised in that said product collection chamber is provided with a thermally insulated stationary top cover, in which is located a conduit for charging molten electrolyte, extending downwardly to below the normal operating upper level of said electrolyte and a product metal outlet, removable cover means for said product metal outlet, and heat exchanger means extending downwardly to below said normal operating upper level of electrolyte for heat exchange contact with said electrolyte.

6. An apparatus according to claim 5 further characterised in that said heat exchanger means is provided with thermal insulation means above said upper electrolyte level for preventing significant heat uptake from molten metal collected in said product collection chamber.

7. An apparatus according to claim 6 further characterised in that spaced electrodes are located in the lower part of said product collection chamber for applying electric resistance heating to molten electrolyte therein.

8. An apparatus according to claim 5, 6 or 7 further characterised in that said heat exchanger means comprises a straight downwardly extending flow pipe for a heat exchange fluid, closed at its lower end, and a return pipe arranged within said flow pipe.

9. An apparatus according to claim 8 further characterised in that said flow pipe is maintained in spaced relation with a surrounding tubular support, to which it is connected at a level below said upper electrolyte level, said tubular support being supported in said stationary cover and being withdrawable therefrom.

10. An apparatus according to claim 5 further characterised in that a gas inlet is provided in said cover for introduction of inert gas into the head space of said product collection chamber.

* * * * *

UNITED STATES PATENT AND TRADEMARK OFFICE

CERTIFICATE OF CORRECTION

PATENT NO. : 4,420,381

DATED : December 13, 1983

INVENTOR(S) : OLIVO G. SIVILOTTI et al.

It is certified that error appears in the above-identified patent and that said Letters Patent are hereby corrected as shown below:

First page of patent, item [75] ("Inventors"), "Silvilotti" should read --Sivilotti-- . This correction should also be reflected at the top of the patent, under item [19].

First page of patent, item [73] ("Assignee"), "Montreal, Calif." should read --Montreal, Canada-- .

Col. 4, lines 10-11, "essentialy" should read --essentially-- .

Col. 5, line 14, "temperatureat" should read --temperature at-- .

Signed and Sealed this

*Fifteenth* Day of *January 1985*

[SEAL]

*Attest:*

*Attesting Officer*

GERALD J. MOSSINGHOFF

*Commissioner of Patents and Trademarks*